US006079616A

United States Patent [19]

Chinks et al.

[11] Patent Number: 6,079,616

[45] Date of Patent: Jun. 27, 2000

[54] ADJUSTABLE BOX

[75] Inventors: Mattie Chinks; Koen De Winter, both of Montreal, Canada

[73] Assignee: Avmor Ltd., Montreal, Canada

[21] Appl. No.: 09/186,193

[22] Filed: Nov. 4, 1998

[30] Foreign Application Priority Data

Jul. 28, 1998 [CA] Canada ..... 2241306

[51] Int. Cl.[7] ..... B65D 5/00

[52] U.S. Cl. ..... 229/101; 229/117; 229/110; 229/155

[58] Field of Search ..... 229/110, 101, 229/117, 103, 155

[56] References Cited

U.S. PATENT DOCUMENTS

| | | | |
|---|---|---|---|
| 2,144,052 | 4/1939 | Kincade, Jr. | 229/110 |
| 2,209,593 | 7/1940 | Bernis | 229/155 X |
| 2,827,222 | 3/1958 | Buttery . | |
| 3,021,045 | 2/1962 | Morris | 229/110 |
| 3,173,579 | 3/1965 | Curie et al. . | |
| 3,598,303 | 8/1971 | Folz . | |
| 3,695,508 | 10/1972 | Hocking | 229/101 |
| 3,727,827 | 4/1973 | Stice . | |
| 3,960,313 | 6/1976 | Sax et al. . | |
| 4,136,817 | 1/1979 | Perry . | |
| 4,230,260 | 10/1980 | Kramer . | |
| 4,235,364 | 11/1980 | Baker . | |
| 4,474,324 | 10/1984 | Forbes, Jr. | 229/101 |
| 4,549,690 | 10/1985 | Rosenburg | 229/110 |
| 4,850,527 | 7/1989 | Church et al. | 229/110 |
| 5,074,460 | 12/1991 | Hanekamp | 229/117 |
| 5,143,278 | 9/1992 | Petriekis et al. . | |
| 5,495,727 | 3/1996 | Strong et al. | 229/101 X |
| 5,755,377 | 5/1998 | Durand | 229/110 |

*Primary Examiner*—Stephen P. Garbe
*Assistant Examiner*—Tri M. Nai
*Attorney, Agent, or Firm*—Robic

[57] ABSTRACT

An adjustable box formed from a blank is disclosed. The box has two rectangular sides; a front panel and a back panel. The front panel and back panel each have two pairs of vertical fold lines on one side thereof, the front pair of vertical fold lines being on the opposite side from the back pair of vertical fold lines. Cooperating flaps including a tongue and groove arrangement are provided to close the box at the top and an automatic setup construction is provided to close the box at the bottom. As a result, the box can be folded along an inner fold line of the front and rear pair of vertical fold lines so that the bottom of the box has a first width. Alternatively, the box can be folded along an outer fold line of the front and rear pair of vertical fold lines so that the bottom of the box has a second width which is smaller than said first width. The cooperating flaps and the automatic setup construction must be adjustable so that once the box is closed at the top and at the bottom, and the box is folded along said inner fold line or said outer fold line, the box remains closed while folding the box between a wide configuration and a narrow configuration.

6 Claims, 5 Drawing Sheets

ADJUSTABLE BOX

FIELD OF THE INVENTION

The present invention concerns an adjustable box. More specifically, the invention relates to an adjustable box where the base of the box can assume one or the other of two configurations.

DESCRIPTION OF THE PRIOR ART

In the art of packaging, it is well known to provide blanks for rectangular boxes, which may be of any size. A blank is usually provided with various fold lines so that the end user folds the blank along the fold lines to form a finished box.

Advances in this field have provided such blanks with a plurality of fold lines, so that a blank may be folded along various fold lines to form a box having a predetermined shape. The selection of the fold lines permits a user to select the size of the resulting box. One such blank is described in U.S. Pat. No. 3,598,303 to FOLZ, which describes a blank which may be selectively folded and locked together in such a manner as to provide a great variety of sizes for a box. A combination of variable fold and cut or trim lines with tab and slot arrangements which provide a multiplicity of sizes in both lateral and transverse directions and in height for boxes or packaging devices is described in this patent. Another such blank is described in U.S. Pat. No. 3,727,827 to STICE and in U.S. Pat. No. 4,235,364 to BAKER.

One of the major disadvantages of these blanks is that once a particular configuration has been selected and the resulting box so assembled, it cannot readily be modified to another configuration, short of disassembling the box and reassembling it into the new configuration. Furthermore, some of the above-mentioned blanks are "one-time", so that once a configuration has been selected, no other configuration can be used for this blank.

In the field of liquid soap dispensers, such as those found in public washrooms, it is known to package the liquid soap in a box. The liquid soap is contained in a plastic collapsible bag, which fits in the box. The plastic bag is provided with a spout which connects to a pump to permit dispensing of the soap in predetermined amounts. The spout can be accessed through a detachable tongue provided on the front of the box.

The box which contains the liquid soap fits in a seat in the liquid soap dispenser which has a predetermined, standard configuration. This standard seat has width of approximately 3½ inches (approximately 8.5 cm) and a length of approximately 3¾ inches (approximately 9.5 cm).

Due to new regulations in the United States, particularly aimed at people with disabilities, new soap dispensers for use in public washrooms must project from a wall to which they are attached by a distance of no more than 4 inches (approximately 10 cm). This new requirement obliges soap dispenser manufacturers to reduce the width of the seats into which the boxes are installed.

Since there are a great number of soap dispensers presently installed, and in order to minimize packaging costs, a distributor of liquid soap must presently stock two types of boxes: the new and the old. This is a considerable inconvenience, since it increases inventory problems and obliges a distributor to carry and ship different boxes according to the type of soap dispenser.

There is thus a need for a box which can fit in the existing seats and which can also fit in the new seats according to the new regulations, and which also contains the same amount (i.e. volume) of liquid soap.

SUMMARY OF THE INVENTION

It is an object of the present invention to provide a box which can be alternatively folded into one or the other of two configurations with minimal manipulation.

In accordance with the invention, this object is achieved with a box formed from a blank, said box comprising: two rectangular sides; a front panel; a back panel.

The front panel and back panel are each provided with two pairs of vertical fold lines on one side thereof, the front pair of vertical fold lines being on the opposite side from the back pair of vertical fold lines.

First means are provided to close the box at the top and second means are also provided to close the box at the bottom.

As a result, the box can be folded along an inner fold line of said front and rear pair of vertical fold lines so that the bottom of the box has a first width. Alternatively, the box can be folded along an outer fold line of said front and rear pair of vertical fold lines so that the bottom of the box has a second width which is smaller than said first width.

Of course, the first and second means to close the box must be adjustable so that once the box is closed at the top and at the bottom, and the box is folded along said inner fold line or said outer fold line, the first and second means to close said box remain closed.

BRIEF DESCRIPTION OF THE DRAWINGS

The present invention and its advantages will be more easily understood after reading the following non-restrictive description of preferred embodiments thereof, made with reference to the following drawings, in which.

DESCRIPTION OF A PREFERRED EMBODIMENT OF THE INVENTION

Figure 1:
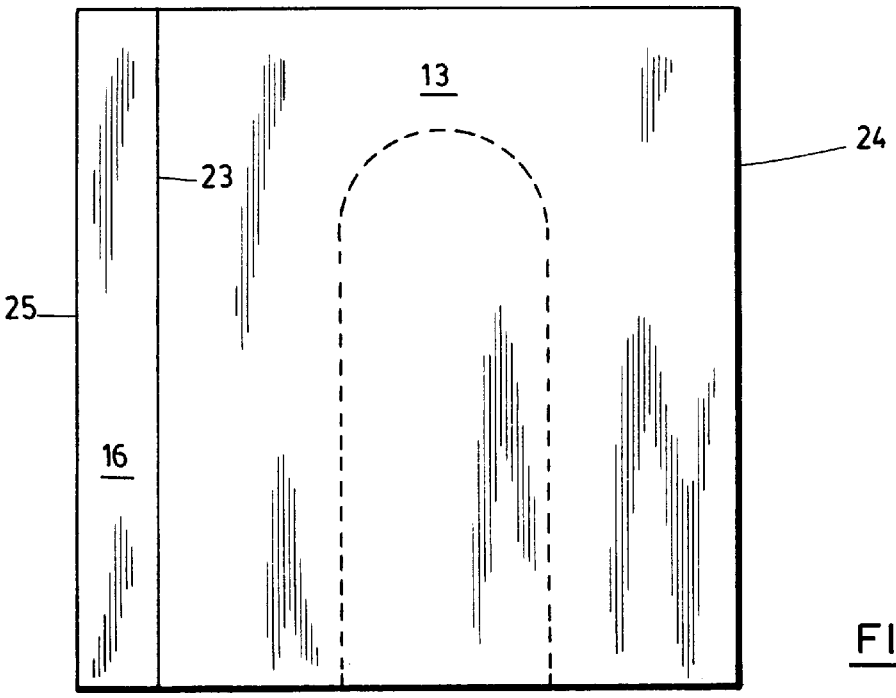
FIG. 1 is a front elevational view of a box according to a preferred embodiment of the invention.

Referring now to FIGS. 1–8, the invention concerns a box, preferably made of cardboard, which can be placed in one or the other of two configurations. These configurations will be hereinafter referred to as the wide configuration and the narrow configuration.

The box 1 according to the invention is made from a blank (see FIG. 7), having four panels 11, 12, 13, 14, of which panels 11 and 13 are respectively the rear and front panels and panels 12 and 14 are the side panels. Panels 12 and 14 have the same size. Panels 11 and 13 have the same size. The blank is also provided with a flap 15 commonly referred to as a manufacturer's flap. The blank according to the invention is further provided with an extension 16 between the panels 12 and 13, and a second flap 18, the purpose of which will be detailed hereinafter.

When the blank is assembled, manufacturer's flap 15 and second flap 18, which preferably have the same width, are glued together.

Extension 16 defines a first pair of fold lines 25, 23, where fold line 25 is referred to as an outside fold line and fold line 23 is referred to as an inner fold line. Flaps 18 and 15 each define a second pair of fold lines 21, 26, where fold line 26 is referred to as an outside fold line and fold line 21 is referred to as an outer fold line.

The blank is also provided with first and second means to close the box at the top and the bottom thereof. The preferred embodiment for the second means, i.e. those that close the box at the bottom thereof, are commonly denoted "automatic setup construction", and are well known in the art. Such a construction makes use of flaps 31, 34 and glue flaps 35, 36. Once these flaps are assembled in the usual manner, the box may be shipped flat, and then prior to use opened. The automatic setup construction is so designed that the bottom of the box closes automatically by virtue of unfolding the box from its flat state. However, if such a construction is used for the second means, the automatic setup construction must be provided with an elongated slot on flaps 31 and 33. As can be seen in FIG. , the slot permits the automatic setup construction to remain closed as the box is opened and folded into the narrow configuration or the wide configuration (see more specifically FIGS. 4 and 6).

An alternative means for closing the box, which can be used at both the top and the bottom, is the provision of inner flaps 51, 53 which can be folded down and cooperating flaps 52, 54, which are further provided with a cooperating tongue 55 and slot 56 arrangement. It should be noted that the inner flaps 51, 53 have the same width as the panels 12, 14, and that the cooperating flaps 52, 54 have the same width as the panels 11, 13. Furthermore, the flaps 52, 54 have a length no longer than the width of the panels 12, 14 and the flaps 51, 53 have a length no longer than the width of the panels 11, 13. This must be so in order for the box to remain closed without interference from the flaps in the narrow and wide configuration.

Figure 2:
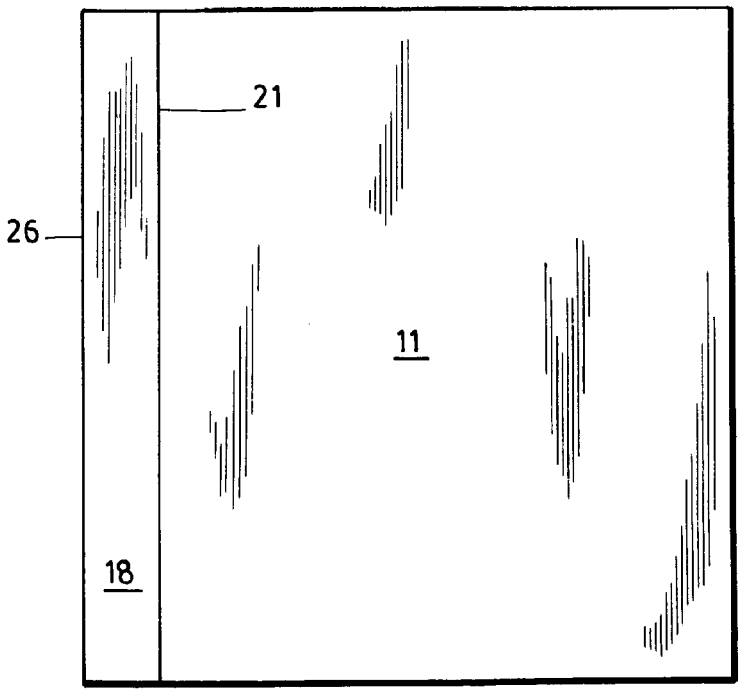
FIG. 2 is a rear elevational view of the box of FIG. 1.
Figure 6:
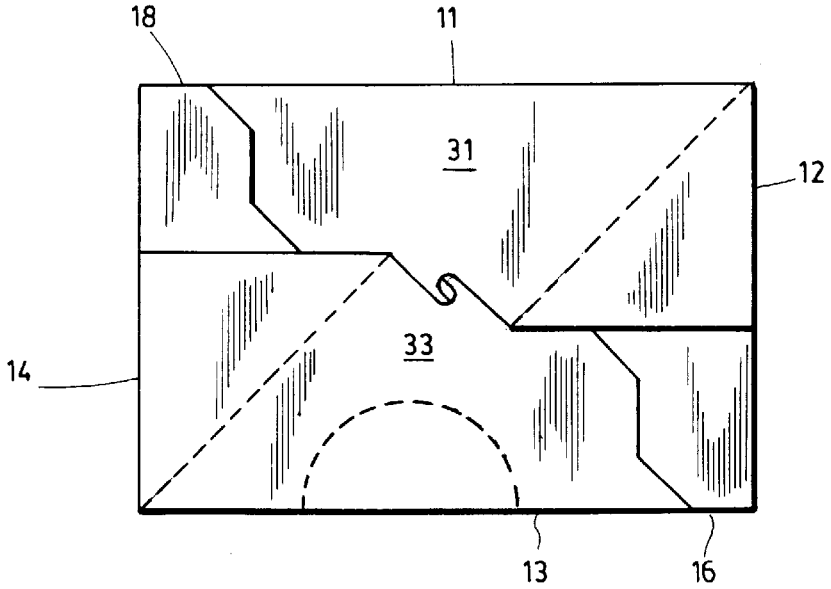
FIG. 6 is a bottom plan view of the box of FIG. 1 in a wide configuration.
Figure 7:
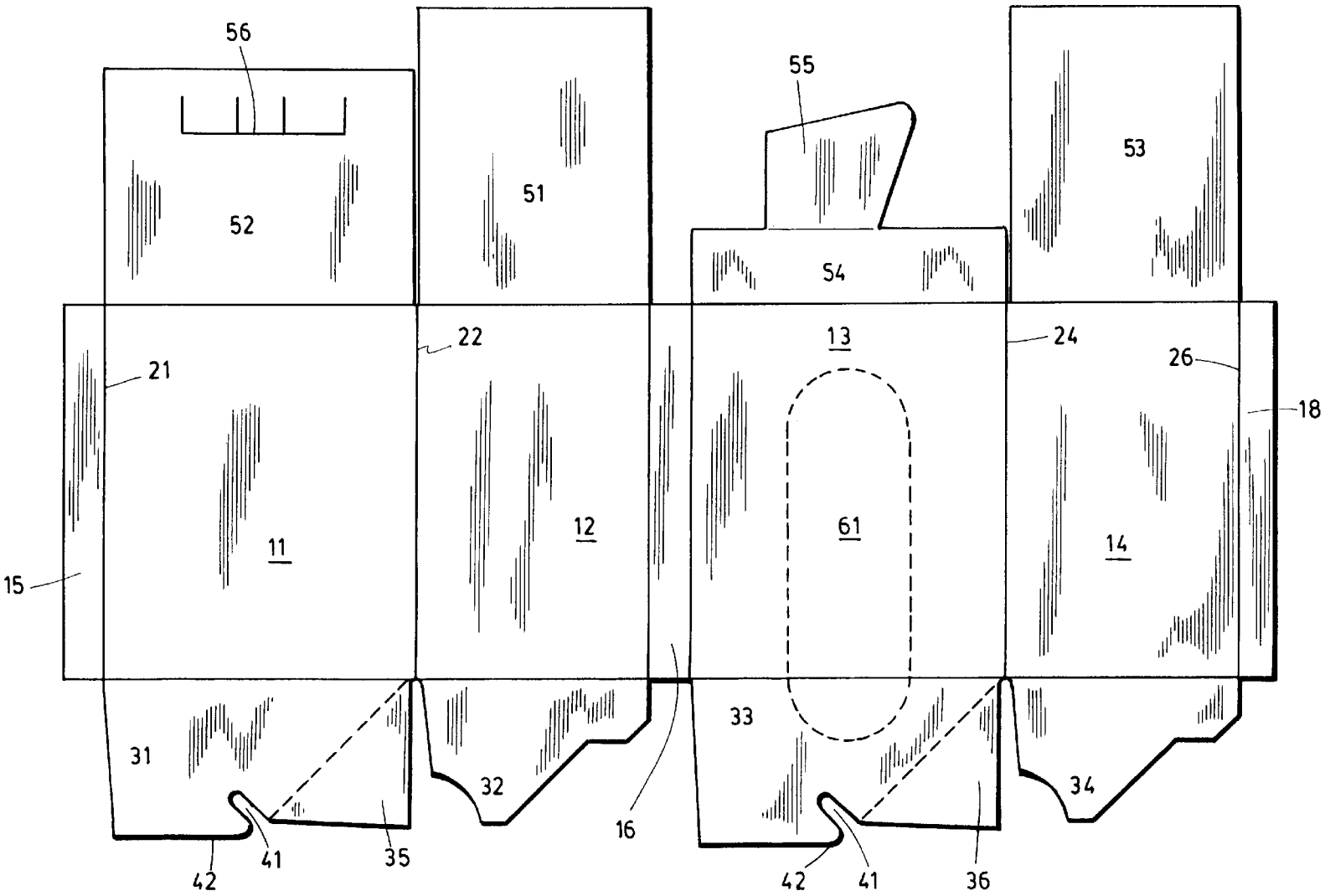
FIG. 7 is a plan view of a blank for the box of FIG. 1.
Figure 8:
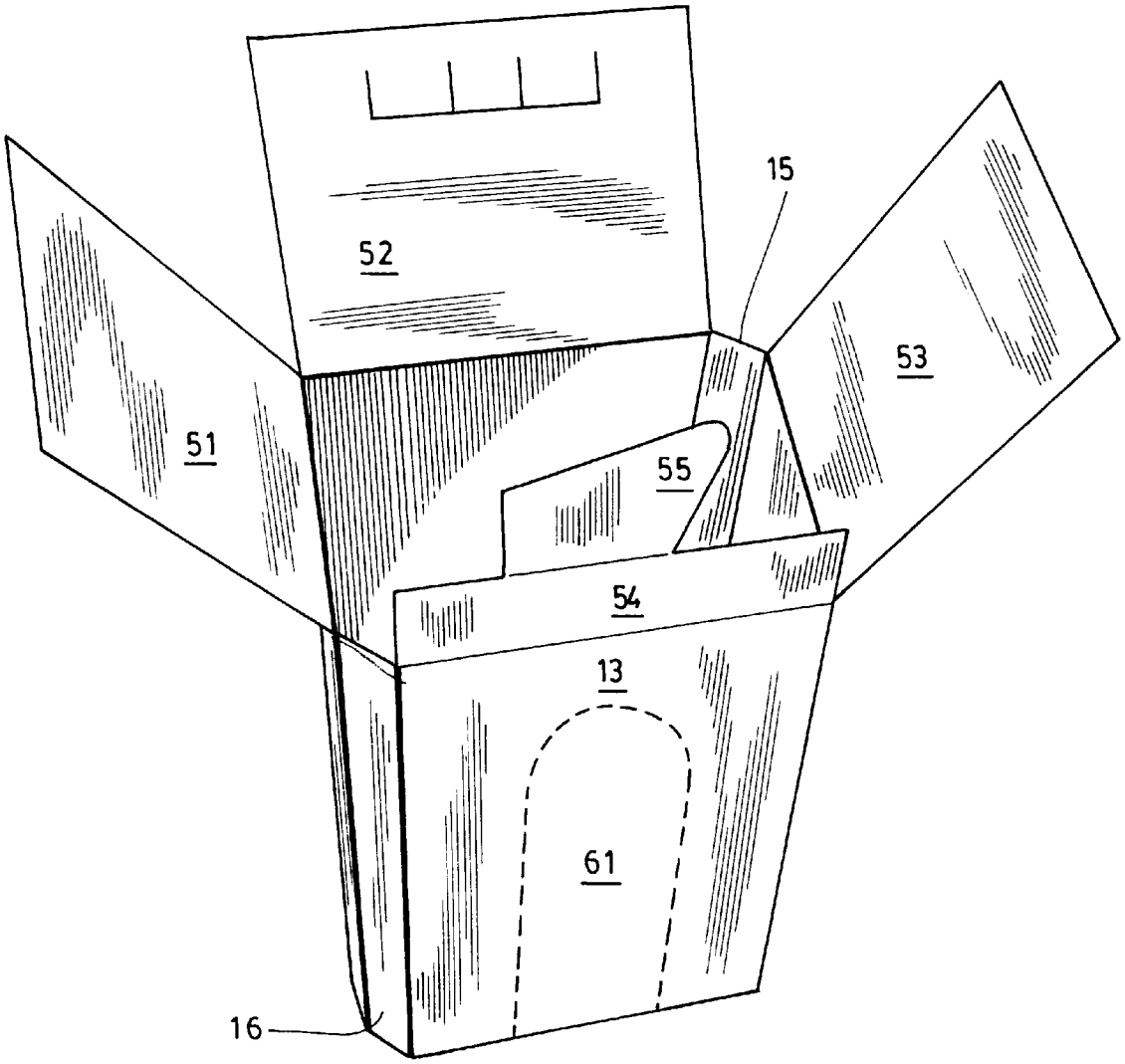
FIG. 8 is a front perspective view of the box of FIG. 1.

Referring now to FIG. 1, the box is shown in its narrow configuration, where the front of the box comprises panel 13 and extension 16. Accordingly, the box is folded along fold line 25 (the outer fold line). FIG. 2 is a rear view of the box, showing that the rear of the box comprises panel 11 and extra flap 18. Accordingly, the box is folded along fold line 26 (the outer fold line). Such a configuration can also be seen from FIGS. 5 and 6, which are top and bottom views respectively. It can also be seen in FIG. 5 that the tongue 55 (shown in dotted lines) is almost completely inserted in the slot 56 and towards the right-hand side thereof, viewed from the top. In FIG. 6, the automatic setup construction must be provided with grooves 41, so that the respective extensions 42 of each of the panels 31 and 33 may interlock.

Figure 3:
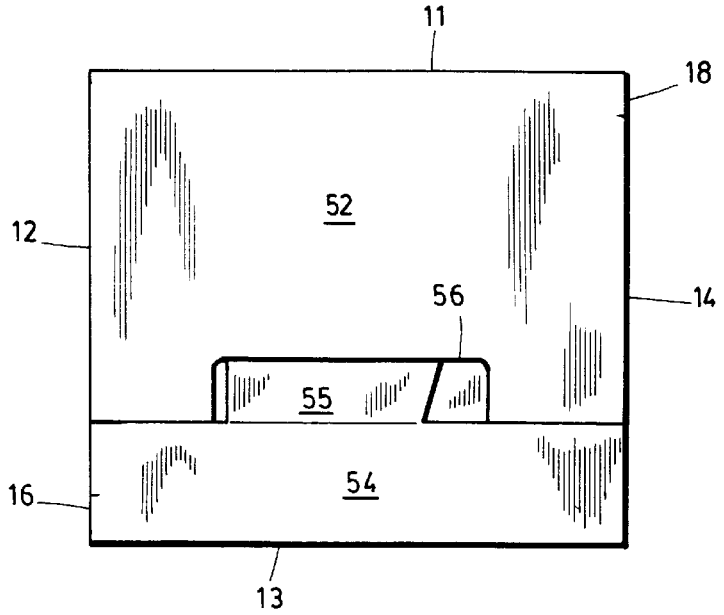
FIG. 3 is a top plan view of the box of FIG. 1 in a narrow configuration.
Figure 4:
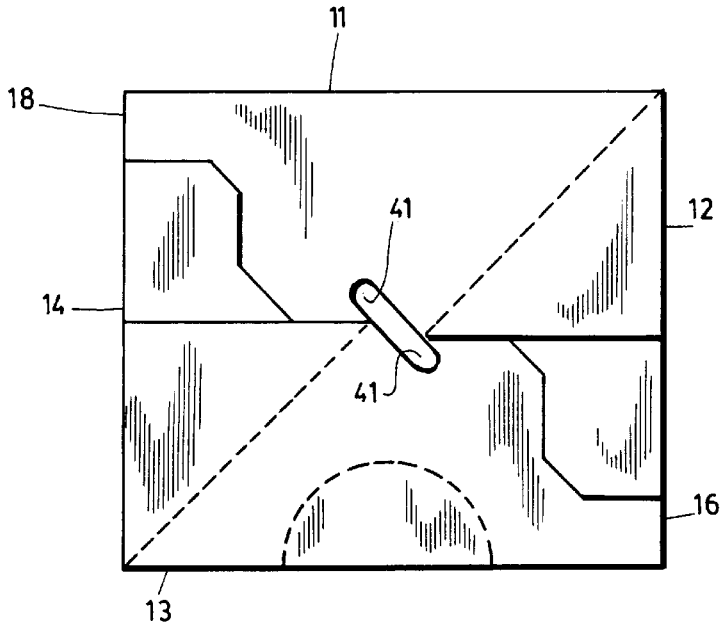
FIG. 4 is a bottom plan view of the box of FIG. 1 in a narrow configuration.
Figure 5:
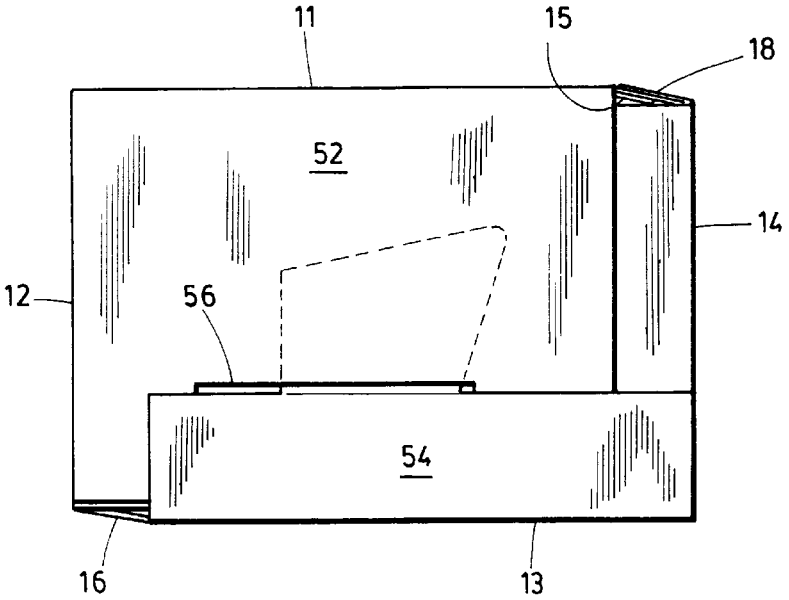
FIG. 5 is a top plan view of the box of FIG. 1 in a wide configuration.

In contrast, FIGS. 3 and 4 show the box in its wide configuration. As can be seen, the tongue 55 is not completely inserted into the slot 56, but the tongue is long enough that the box remains closed. Furthermore, the grooves 41 are open, but nevertheless the automatic setup construction maintains the box in the unfolded position.

Thus, the box may be assembled from a blank and shipped and stored in a flat state. When the box is unfolded from its flat state, it can be loaded with the desired product. Flaps 51 and 53 are folded inwardly, flap 52 is subsequently folded inwardly and the tongue 55 of flap 54 is inserted into the slot 56 in order to close the box. Afterwards, should the box be required to be placed in a narrow configuration or a wide configuration, one has to simply fold (or re-fold) the box along the inner fold lines or the outer fold lines.

If such a box is to be used to dispense liquid soap, the box is further provided with a detachable tongue 61. Thus, once the box is loaded with a plastic bag containing the liquid soap, it can be installed in seats of dispensers having a wide base or a narrow base. Furthermore, since the plastic bags also contain a spout from which the soap may be dispensed, the detachable tongue 61 may be removed in order to provide access to the spout.

It should be understood that terms "front", "rear", "side", "top" and "bottom" are relative terms. The important aspect of the invention is that the box be provided with two pairs of fold lines in order to provide a narrow or wide configuration. Another important aspect is that should it be desired for the box to remain closed prior to deciding which configuration will be used for the box, the means for closing the box at the top and the bottom must be adjustable and must allow for relative movement. Also, the blank from which the box is formed has been shown in a preferred embodiment, and it should be understood that other blank may be used to fulfill the objects of the invention.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. An adjustable box having a top, a bottom, a front, a back and two opposite sides, said top and said bottom defining a length and width of said box, said box comprising: two rectangular sides; a front panel; a back panel; the front panel being provided with a front pair of parallel, vertical fold lines on one side thereof and the back panel being provided with a back pair of parallel vertical fold lines on one side thereof; the front pair of parallel vertical fold lines being diagonally opposite the back pair of vertical fold lines; said box further comprising first means for closing said box at the top and adjusting the length and the width of the box simultaneously and a second means for closing said box at the bottom and adjusting the length and the width of the box simultaneously; whereby in use, when at least one of said first and second adjustable means of said box is closed, said box is foldable along an inner fold line of the front and back pair of vertical fold lines so that said the box has a first width and a first length and the box is foldable along an outer fold line of the front and back pair of vertical fold lines so that the box has a second width which is smaller than the first width and a second length longer than the first length.

2. An adjustable box according to claim 1, wherein said box is made of cardboard.

3. An adjustable box according to claim 1, wherein said second adjustable means are an automatic set-up construction.

4. An adjustable box according to claim 1, wherein said first adjustable means comprise a first and second flap extending from each of said rectangular sides respectively, each of said first and second flap having a width equal to said second width and a length less than said width of said front panel; a third flap extending from said back panel, said third flap having a width, equal to said width of said back panel and a length less than said width of said rectangular sides, a fourth flap extending from said front panel, said fourth flap having a width equal to said width of said front panel and a length less than said width of said rectangular sides, said third and fourth flaps being provided with a cooperating tongue and groove construction, whereby said tongue may slide along said groove as said box is folded from having said first width to having said second width and conversely.

5. An adjustable box according to claim 4, wherein said second adjustable means are an automatic set-up construction.

6. An adjustable box according to claim 5, wherein said box is made of cardboard.

* * * * *